US009791801B2

(12) United States Patent
Yokoi

(10) Patent No.: US 9,791,801 B2
(45) Date of Patent: Oct. 17, 2017

(54) EXPOSING DEVICE, CONTROLLING METHOD THEREOF, AND STORAGE MEDIUM STORING PROGRAM FOR CONTROLLER OF EXPOSING DEVICE

(71) Applicant: BROTHER KOGYO KABUSHIKI KAISHA, Nagoya-shi, Aichi-ken (JP)

(72) Inventor: Junichi Yokoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/278,554

(22) Filed: Sep. 28, 2016

(65) Prior Publication Data

US 2017/0090338 A1 Mar. 30, 2017

(30) Foreign Application Priority Data

Sep. 29, 2015 (JP) ..... 2015-190926

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
USPC ..... 399/1–4, 118, 177, 198, 220; 347/224, 347/227, 235, 238, 256; 358/340
See application file for complete search history.

(56) References Cited

U.S. PATENT DOCUMENTS 7,995,085 B2 * 8/2011 Nomura ..... B41J 2/451 347/238
8,149,259 B2 * 4/2012 Nagumo ..... G03G 15/326 347/118
8,692,860 B2 * 4/2014 Inoue ..... B41J 2/45 347/130
9,041,761 B2 * 5/2015 Hamanaka ..... G03G 15/043 347/116
9,417,552 B2 * 8/2016 Kim ..... H05B 33/0842
9,588,455 B2 * 3/2017 Yokoi ..... G03G 15/043
2004/0100552 A1 5/2004 Taira et al.
2009/0041504 A1 * 2/2009 Yamaguchi ..... B41J 2/451 399/220

FOREIGN PATENT DOCUMENTS

JP 2004-174785 A 6/2004
JP 2013-028123 A 2/2013
JP 2013-049156 A 3/2013
JP 2014-104718 A 6/2014

* cited by examiner

*Primary Examiner* — Hoan Tran
(74) *Attorney, Agent, or Firm* — Merchant & Gould P.C.

(57) ABSTRACT

An exposing device is configured to form a halftone electrostatic latent image on a photosensitive surface by hatching having oblique lines inclined relative to a main scanning direction, and when an interval between first and second chips in the main scanning direction is larger than a first particular value, controls light emission of a plurality of light emitting elements such that light amounts of first and second light emitting elements are larger than light amounts of light emitting elements in a middle region and that the light amount of the second light emitting element is smaller than the light amount of the first light emitting element. The first light emitting element is a light emitting element provided on the first chip and closest to the second chip. The second light emitting element is a light emitting element provided on the second chip and closest to the first chip.

20 Claims, 9 Drawing Sheets

FIG. 9A

CORRECTION AMOUNTS WHEN G > Gth1

| | | FIRST CHIP | | | | SECOND CHIP | | | |
|---|---|---|---|---|---|---|---|---|---|
| | | P | P6 | P4 | P1 | P2 | P3 | P5 | P |
| CORRECTION PATTERN | 1 | 0 | 0 | 0 | +15 | +10 | 0 | 0 | 0 |
| | 2 | 0 | 0 | 0 | +15 | +10 | +10 | 0 | 0 |
| | 3 | 0 | 0 | 0 | +15 | +10 | +15 | 0 | 0 |
| | 4 | 0 | 0 | +10 | +15 | +10 | +10 | 0 | 0 |
| | 5 | 0 | 0 | +10 | +15 | +10 | +15 | 0 | 0 |
| | 6 | 0 | +5 | +10 | +15 | +10 | +15 | +5 | 0 |

FIG. 9B

CORRECTION AMOUNTS WHEN G < Gth2

| | | FIRST CHIP | | | | SECOND CHIP | | | |
|---|---|---|---|---|---|---|---|---|---|
| | | P | P6 | P4 | P1 | P2 | P3 | P5 | P |
| CORRECTION PATTERN | 1 | 0 | 0 | 0 | -15 | -10 | 0 | 0 | 0 |
| | 2 | 0 | 0 | 0 | -15 | -10 | -10 | 0 | 0 |
| | 3 | 0 | 0 | 0 | -15 | -10 | -15 | 0 | 0 |
| | 4 | 0 | 0 | -10 | -15 | -10 | -10 | 0 | 0 |
| | 5 | 0 | 0 | -10 | -15 | -10 | -15 | 0 | 0 |
| | 6 | 0 | -5 | -10 | -15 | -10 | -15 | -5 | 0 |

EXPOSING DEVICE, CONTROLLING METHOD THEREOF, AND STORAGE MEDIUM STORING PROGRAM FOR CONTROLLER OF EXPOSING DEVICE

CROSS REFERENCE TO RELATED APPLICATIONS

This application claims priority from Japanese Patent Application No. 2015-190926 filed Sep. 29, 2015. The entire content of the priority application is incorporated herein by reference.

TECHNICAL FIELD

This disclosure relates to an exposing device, a controlling method thereof, and a storage medium storing a program for a controller of the exposing device.

BACKGROUND

In an image forming apparatus of an electro-photographic type, an electrostatic latent image is formed on a photosensitive member by exposing the photosensitive member. Some exposing devices used for this exposure in recent years have an exposing head in which a plurality of light emitting elements such as LED is arrayed in the main scanning direction (the direction perpendicular to the direction in which a paper sheet is conveyed).

In this type of exposing head, a plurality of chips is arranged in the main scanning direction, each chip having a plurality of light emitting elements arrayed in the main scanning direction perpendicular to the sheet conveying direction. The light emitting elements in each chip are arrayed at generally accurate pitch with small manufacturing variations. On the other hand, there are manufacturing variations in the arrangement of the chips. Thus, the pitch between light emitting elements is not constant at joints of the chips. Hence, conventionally, the light amounts of light emitting elements are changed depending on the distance between the light emitting elements at a joint of chips, or a correction pattern is changed depending on the angle of a dither pattern having oblique lines relative to the main scanning direction, so as to suppress occurrence of a color streak (black streak) and a white streak in an image.

SUMMARY

According to one aspect, this specification discloses an exposing device. The exposing device includes a light emitting head and a controller. The light emitting head has a plurality of chips arranged in a main scanning direction. The plurality of chips includes a first chip and a second chip closest to the first chip. Each of the plurality of chips has a plurality of light emitting elements arranged in the main scanning direction. The plurality of light emitting elements emits light to a photosensitive surface. Each of the plurality of chips has an end region and a middle region. The end region is a region having at least one of the plurality of light emitting elements close to an adjacent chip. The middle region is a region having the plurality of light emitting elements other than the at least one of the plurality of light emitting elements in the end region. The controller is connected to the light emitting head, wherein: the controller is configured to operate the light emitting head to form a halftone electrostatic latent image on the photosensitive surface by emitting light from the plurality of light emitting elements, the halftone electrostatic latent image being an image made by hatching having oblique lines inclined relative to the main scanning direction; and when an interval between the first chip and the second chip in the main scanning direction is larger than a first particular value, the controller is configured to control the plurality of light emitting elements to emit light such that a light amount of a first light emitting element and a light amount of a second light emitting element are larger than light amounts of light emitting elements in the middle region and that the light amount of the second light emitting element is smaller than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

According to another aspect, this specification also discloses an exposing device. The exposing device includes a light emitting head and a controller. The light emitting head has a plurality of chips arranged in a main scanning direction. The plurality of chips includes a first chip and a second chip closest to the first chip. Each of the plurality of chips has a plurality of light emitting elements arranged in the main scanning direction. The plurality of light emitting elements emits light to a photosensitive surface. Each of the plurality of chips has an end region and a middle region. The end region is a region having at least one of the plurality of light emitting elements close to an adjacent chip. The middle region is a region having the plurality of light emitting elements other than the at least one of the plurality of light emitting elements in the end region. The controller is connected to the light emitting head, wherein: the controller is configured to operate the light emitting head to form a halftone electrostatic latent image on the photosensitive surface by emitting light from the plurality of light emitting elements, the halftone electrostatic latent image being an image made by hatching having oblique lines inclined relative to the main scanning direction; and when an interval between the first chip and the second chip in the main scanning direction is smaller than a second particular value, the controller is configured to control the plurality of light emitting elements to emit light such that a light amount of a first light emitting element and a light amount of a second light emitting element are smaller than light amounts of light emitting elements in the middle region and that the light amount of the second light emitting element is larger than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

According to still another aspect, this specification also discloses a method of controlling an exposing device including a light emitting head having a plurality of chips arranged in a main scanning direction. The plurality of chips includes a first chip and a second chip closest to the first chip. Each of the plurality of chips has a plurality of light emitting elements arranged in the main scanning direction. The plurality of light emitting elements emits light to a photosensitive surface. Each of the plurality of chips has an end region and a middle region. The end region is a region having at least one of the plurality of light emitting elements close to an adjacent chip. The middle region is a region having the plurality of light emitting elements other than the at least one of the plurality of light emitting elements in the end region. The method includes: operating the light emitting head to form a halftone electrostatic latent image on the photosensitive surface by emitting light from the plurality of light emitting elements, the halftone electrostatic latent image being an image made by hatching having oblique lines inclined relative to the main scanning direction. The operating the light emitting head includes: when an interval between the first chip and the second chip in the main scanning direction is larger than a first particular value, controlling the plurality of light emitting elements to emit light such that a light amount of a first light emitting element and a light amount of a second light emitting element are larger than light amounts of light emitting elements in the middle region and that the light amount of the second light emitting element is smaller than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

According to still another aspect, this specification also discloses a non-transitory computer-readable storage medium storing instructions executable by a controller of an exposing device. The exposing device includes a light emitting head having a plurality of chips arranged in a main scanning direction. The plurality of chips includes a first chip and a second chip closest to the first chip. Each of the plurality of chips has a plurality of light emitting elements arranged in the main scanning direction. The plurality of light emitting elements emits light to a photosensitive surface. Each of the plurality of chips has an end region and a middle region. The end region is a region having at least one of the plurality of light emitting elements close to an adjacent chip. The middle region is a region having the plurality of light emitting elements other than the at least one of the plurality of light emitting elements in the end region. When executed by the controller, the instructions cause the exposing device to perform: operating the light emitting head to form a halftone electrostatic latent image on the photosensitive surface by emitting light from the plurality of light emitting elements, the halftone electrostatic latent image being an image made by hatching having oblique lines inclined relative to the main scanning direction. The operating the light emitting head includes: when an interval between the first chip and the second chip in the main scanning direction is larger than a first particular value, controlling the plurality of light emitting elements to emit light such that a light amount of a first light emitting element and a light amount of a second light emitting element are larger than light amounts of light emitting elements in the middle region and that the light amount of the second light emitting element is smaller than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

The interval between the first chip and the second chip in the main scanning direction means the pitch (center-to-center distance) between the first light emitting element and the second light emitting element in the main scanning direction. In a case where each chip has a light emitting element at an end in the main scanning direction that is not used (not lighted), the light emitting element that is not used is excluded from the light emitting element of this disclosure. For example, out of the light emitting elements in the first chip that are used, the light emitting element closest to the second chip is the first light emitting element.

BRIEF DESCRIPTION OF THE DRAWINGS

Embodiments in accordance with this disclosure will be described in detail with reference to the following figures wherein:

FIGS. 6A to 6D are diagrams showing dot arrangement of halftone by oblique lines, wherein FIG. 6A shows a case of density 33% and a small inclination angle, FIG. 6B shows a case of density 33% and a large inclination angle, FIG. 6C shows a case of density 33% and a small line-to-line distance, and FIG. 6D shows a case of density 66% and a large inclination angle;

FIG. 9A is a table showing patterns of correction amounts of each light emitting element in the case of $G>Gth1$;

FIG. 9B is a table showing patterns of correction amounts of each light emitting element in the case of $G<Gth2$.

DETAILED DESCRIPTION

In light amount correction of a joint of chips according to a conventional method, there are cases in which correction is excessive and a color streak or a white streak occurs depending on the dither pattern. For example, when an image is formed by a dither pattern having oblique lines inclined relative to the main scanning direction, if light amount correction of the conventional method is performed in a case where the angle of oblique lines is larger than a particular angle or a case where the line-to-line distance of adjacent oblique lines is smaller than a particular distance, occurrence of a white streak can be suppressed, but pixels at the corrected portion may stand out (strengthen each other excessively) and a color streak may occur at a portion where the distance between light emitting elements at a joint of chips is larger than a standard pitch. Similarly, occurrence of a color streak can be suppressed, but a white streak may occur at a portion where the distance between light emitting elements at a joint of chips is smaller than a standard pitch.

In view of the foregoing, an example of the object of this disclosure is to provide an exposing device, a controlling method thereof, and a storage medium storing a program for a controller of the exposing device, that are configured to appropriately suppress occurrence of a color streak and a white streak at a joint of chips.

Some aspects of this disclosure will be described while referring to the accompanying drawings.

<Overall Configuration of Color Printer>

Figure 1:
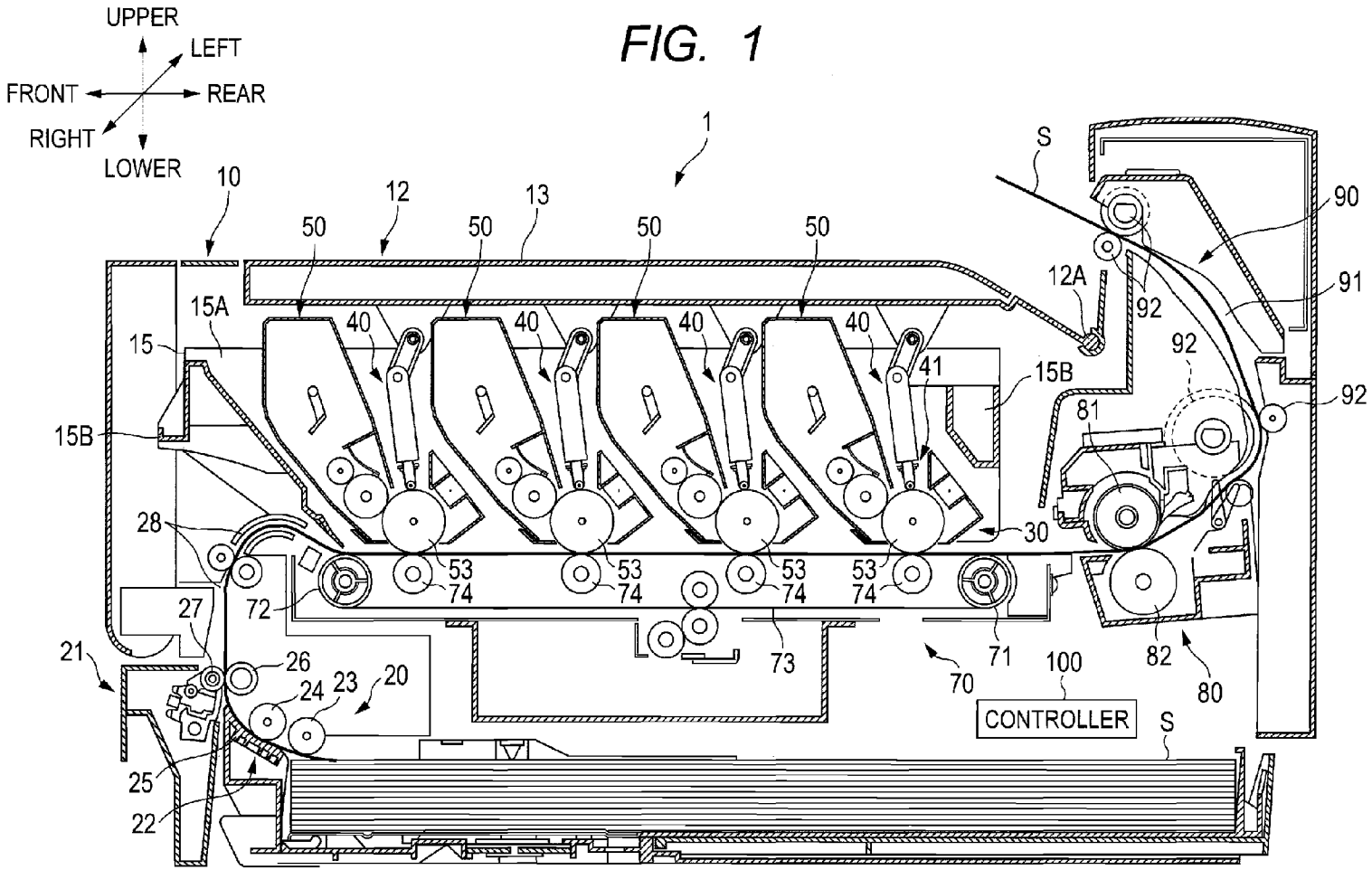
FIG. 1 is a cross-sectional view showing the overall configuration of a color printer embodying an exposing device according to an embodiment.

A color printer 1 of an electro-photographic type is an example of an image forming apparatus to which an exposing device of this disclosure is applied. As shown in FIG. 1, the color printer 1 includes, within a main casing 10, a sheet feeding section 20 configured to feed sheet S, an image forming section 30 configured to form an image on the fed sheet S, a sheet discharging section 90 configured to discharge sheet S on which an image is formed, and a controller 100 configured to control operations of these sections. In the following description, the expressions "front", "rear", "right", and "left" are used to define the various parts from the viewpoint of the user using the color printer. That is, in FIG. 1, the left side of the drawing sheet is defined as "front side", the right side of the drawing sheet is defined as "rear side", the far side in the direction perpendicular to the drawing sheet is defined as "left side", and the near side in the direction perpendicular to the drawing sheet is defined as "right side". Further, the upper-lower direction in the drawing sheet is defined as "upper-lower direction".

An upper cover 12 is provided at an upper part of the main casing 10 so as to open and close relative to the main casing 10. More specifically, the upper cover 12 is pivotally movable up and down about a hinge 12A provided at the rear end of the upper cover 12. The upper surface of the upper cover 12 constitutes a sheet discharging tray 13 configured to accumulate sheet S discharged from the main casing 10. LED units 40 are provided at the lower side of the upper cover 12.

A cartridge drawer 15 configured to detachably accommodate each process cartridge 50 is provided within the main casing 10. The cartridge drawer 15 includes a pair of left and right metal side plates 15A (only one side is shown in FIG. 1) and a pair of front and rear cross members 15B connecting the pair of the side plates 15A. The side plates 15A are arranged at the both sides of LED heads 41 of the LED units 40 in the left-right direction. The side plates 15A are members that directly or indirectly support and locate the photosensitive drums 53.

The sheet feeding section 20 is provided at a lower part in the main casing 10. The sheet feeding section 20 mainly includes a sheet feeding tray 21 and a sheet feeding mechanism 22. The sheet feeding tray 21 is detachably mounted on the main casing 10. The sheet feeding mechanism 22 conveys sheet S from the sheet feeding tray 21 to the image forming section 30. The sheet feeding mechanism 22 is provided at the front side of the sheet feeding tray 21, and mainly includes a sheet feeding roller 23, a separating roller 24, and a separating pad 25.

In the sheet feeding section 20 configured in this way, sheet S in the sheet feeding tray 21 is separated one sheet at a time and is sent upward, paper powders are removed in the process where the sheet S passes between a paper powder removing roller 26 and a pinch roller 27, and thereafter the sheet S passes through a conveying path 28 and changes its direction rearward, and the sheet S is supplied to the image forming section 30.

The image forming section 30 mainly includes four LED units 40, four process cartridges 50, a transfer unit 70, and a fixing unit 80.

Figure 2:
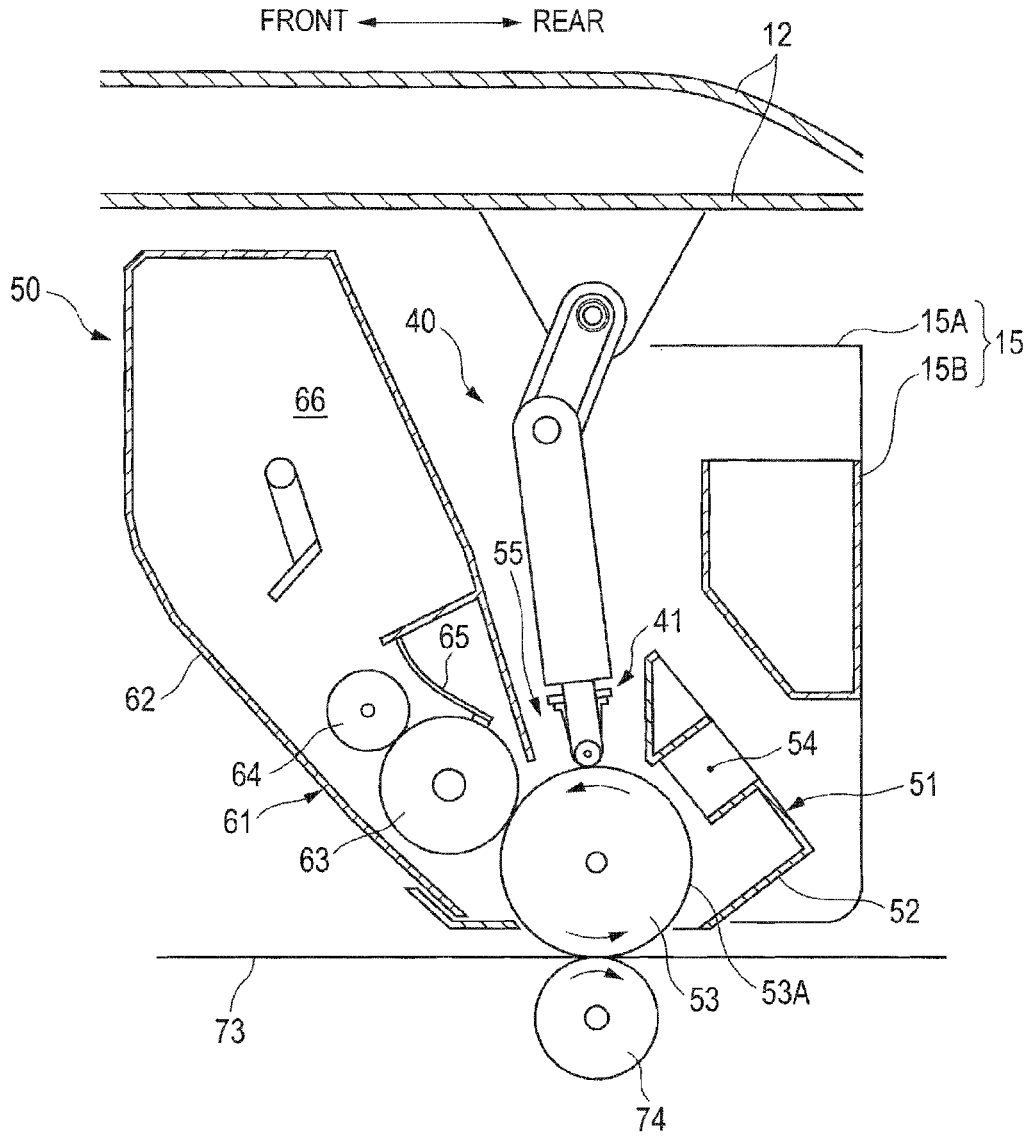
FIG. 2 is an enlarged view showing an LED unit and a process cartridge.

The process cartridges 50 are arranged in the front-rear direction between the upper cover 12 and the sheet feeding section 20. As shown in FIG. 2, the process cartridge 50 includes a drum unit 51 and a developing unit 61 detachably mounted on the drum unit 51. The side plates 15A support the process cartridges 50, and the process cartridge 50 supports the photosensitive drum 53. Each process cartridge 50 has the same configuration except that toner of different colors is accommodated in a toner accommodating chamber 66 of the developing unit 61.

The drum unit 51 mainly includes a drum frame 52, the photosensitive drum 53 supported rotatably by the drum frame 52, and a Scorotron charger 54.

The developing unit 61 includes a developing frame 62, a developing roller 63 and a supplying roller 64 rotatably supported by the developing frame 62, and a layer-thickness regulating blade 65. The developing unit 61 has the toner accommodating chamber 66 configured to accommodate toner. In the process cartridge 50, the developing unit 61 is mounted on the drum unit 51, thereby forming an exposure hole 55 through which the photosensitive drum 53 can be seen, from upward, between the developing frame 62 and the drum frame 52. The LED unit 40 holding the LED head 41 at its lower end is inserted into the exposure hole 55.

As shown in FIG. 1, the transfer unit 70 is provided between the sheet feeding section 20 and each process cartridge 50, and mainly includes a drive roller 71, a follow roller 72, a conveying belt 73, and transfer rollers 74.

The drive roller 71 and the follow roller 72 are arranged spaced away from each other in the front-rear direction and in parallel with each other. The conveying belt 73 that is an endless belt is looped around the drive roller 71 and the follow roller 72. The outer surface of the conveying belt 73 is in contact with each photosensitive drum 53. Inside the conveying belt 73, the four transfer rollers 74 configured to nippingly hold the conveying belt 73 with the respective photosensitive drum 53 are arranged to face the respective photosensitive drums 53. A transfer bias is applied to the transfer roller 74 by constant current control at the time of transfer.

The fixing unit 80 is disposed at the rear side of the process cartridges 50 and the transfer unit 70. The fixing unit 80 includes a heating roller 81 and a pressure roller 82 disposed to face the heating roller 81 and configured to press the heating roller 81.

In the image forming section 30 configured in this way, first, a surface of each photosensitive drum 53 (photosensitive surface 53A) is uniformly charged by the Scorotron charger 54. After that, while the photosensitive surface 53A moves relative to the LED head 41 in the sub-scanning direction perpendicular to the main scanning direction, the photosensitive surface 53A is exposed by LED light irradiated from each LED head 41. With this operation, the potential of the exposed portions drops, and an electrostatic latent image based on image data is formed on the photosensitive surface 53A of each photosensitive drum 53.

Further, toner in the toner accommodating chamber 66 is supplied to the developing roller 63 due to rotation of the supplying roller 64, and enters between the developing roller 63 and the layer-thickness regulating blade 65 due to rotation of the developing roller 63 and is borne on the developing roller 63 as a thin layer of a constant thickness.

When the developing roller 63 faces and contacts the photosensitive drum 53, the toner borne on the developing roller 63 is supplied to the electrostatic latent image formed on the photosensitive drum 53. With this operation, toner is selectively borne on the photosensitive drum 53, the electrostatic latent image is visualized, and a toner image is formed by reversal development.

Next, the sheet S supplied onto the conveying belt 73 passes between each photosensitive drum 53 and the corresponding transfer roller 74 disposed inside the conveying belt 73, causing the toner image formed on each photosensitive drum 53 is transferred onto the sheet S. Then, the sheet S passes between the heating roller 81 and the pressure roller 82, and the toner image transferred onto the sheet S is thermally fixed.

The sheet discharging section 90 mainly includes a discharging-side conveying path 91 and a plurality of pairs of conveying rollers 92. The discharging-side conveying path 91 is formed to extend upward from the exit of the fixing unit 80 and turn to the front side. The plurality of pairs of conveying rollers 92 is configured to convey sheet S. The sheet S on which the toner image is transferred and thermally fixed is conveyed along the discharging-side conveying path 91 by the conveying rollers 92, and is discharged to outside the main casing 10 and accumulated on the sheet discharging tray 13.

<Configuration of LED Head>

Figure 3:
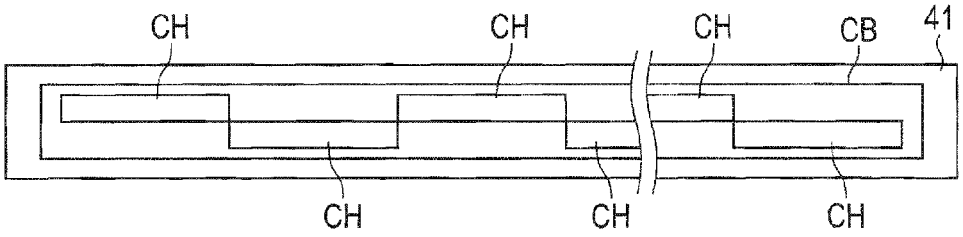
FIG. 3 is a diagram of the LED unit as viewed from an exposure surface side.

The LED head 41 is a member in which a plurality of light emitting elements is arranged in the main scanning direction (that is, the direction perpendicular to the conveying direction of sheet S; the left-right direction in the present embodiment). As shown in FIG. 3, a circuit board CB is provided on the downward-facing exposure surface facing the photosensitive drum 53 of the LED head 41. On the circuit board CB, a plurality of LED array chips (hereinafter, abbreviated as "chip CH") is arranged in the main scanning direction. In the surface of each chip CH, fine LED (Light Emitting Diode) elements as an example of light emitting elements are formed by a semiconductor process. In the present embodiment, 20 chips CH are arranged on the circuit board CB. When light emitting signals are inputted by the controller 100 described later, the chip CH emits light sequentially from the scan start side (for example, the left side in FIG. 3) toward the scan end side (for example, the right side in FIG. 3) in the main scanning direction, or emits light concurrently to expose the photosensitive drum 53.

Figure 4:
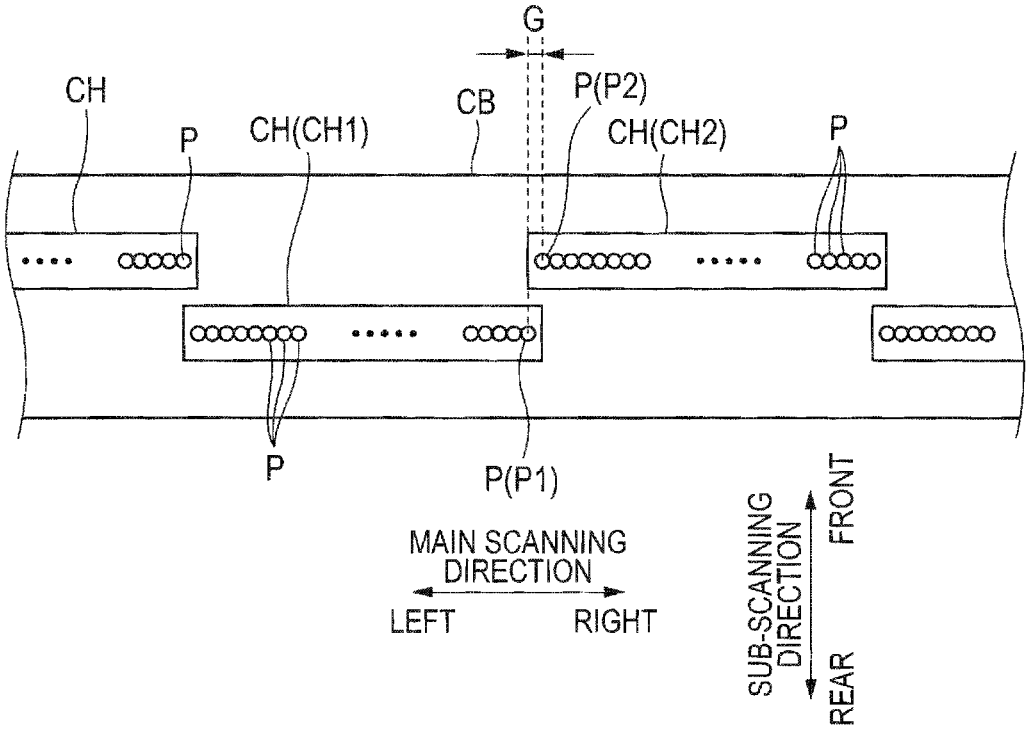
FIG. 4 is an enlarged view showing the arrangement of LED array chips arranged on the exposure surface of the LED unit and light emitting elements.

As shown in FIG. 4, in each chip CH, light emitting elements P of LED are arrayed closely in line in the main scanning direction. Due to the manufacturing process of the chip CH, the light emitting elements P cannot be formed at an edge of the chip CH. Hence, the plurality of chips CH is not arranged in one straight line in the main scanning direction, but adjacent ones of the plurality of chips CH are arranged to be shifted in the sub-scanning direction. Thus, the plurality of chips CH is arranged such that an interval G, in the main scanning direction, between a first light emitting element P1 at one end (right end) of a first chip CH1 and a second light emitting element P2 at the other end (left end) of a second chip CH2 adjacent to the first chip CH1 at the one end side is equal to approximately one pitch of the light emitting elements P in each chip CH (this will be referred to as "standard pitch". The interval G is also referred to as the interval between the first chip CH1 and the second chip CH2 in the main scanning direction. The interval G at a joint of the chips CH is ideally the same as the standard pitch. However, there arises a variation (error) when the chips CH are mounted on the circuit board CB, and hence, actually, the interval G may be larger than or smaller than the standard pitch.

In the present embodiment, adjacent chips CH are alternately shifted from each other in the front-rear direction to form a staggered (zigzag) arrangement. However, the arrangement need not necessarily be a staggered arrangement. For example, the chips CH may be arranged such that each chip CH takes one of three positions shifted in the sub-scanning direction.

<Configuration of Controller>

As shown in FIG. 1, the controller 100 is provided at an appropriate position in the color printer 1.

Figure 5:
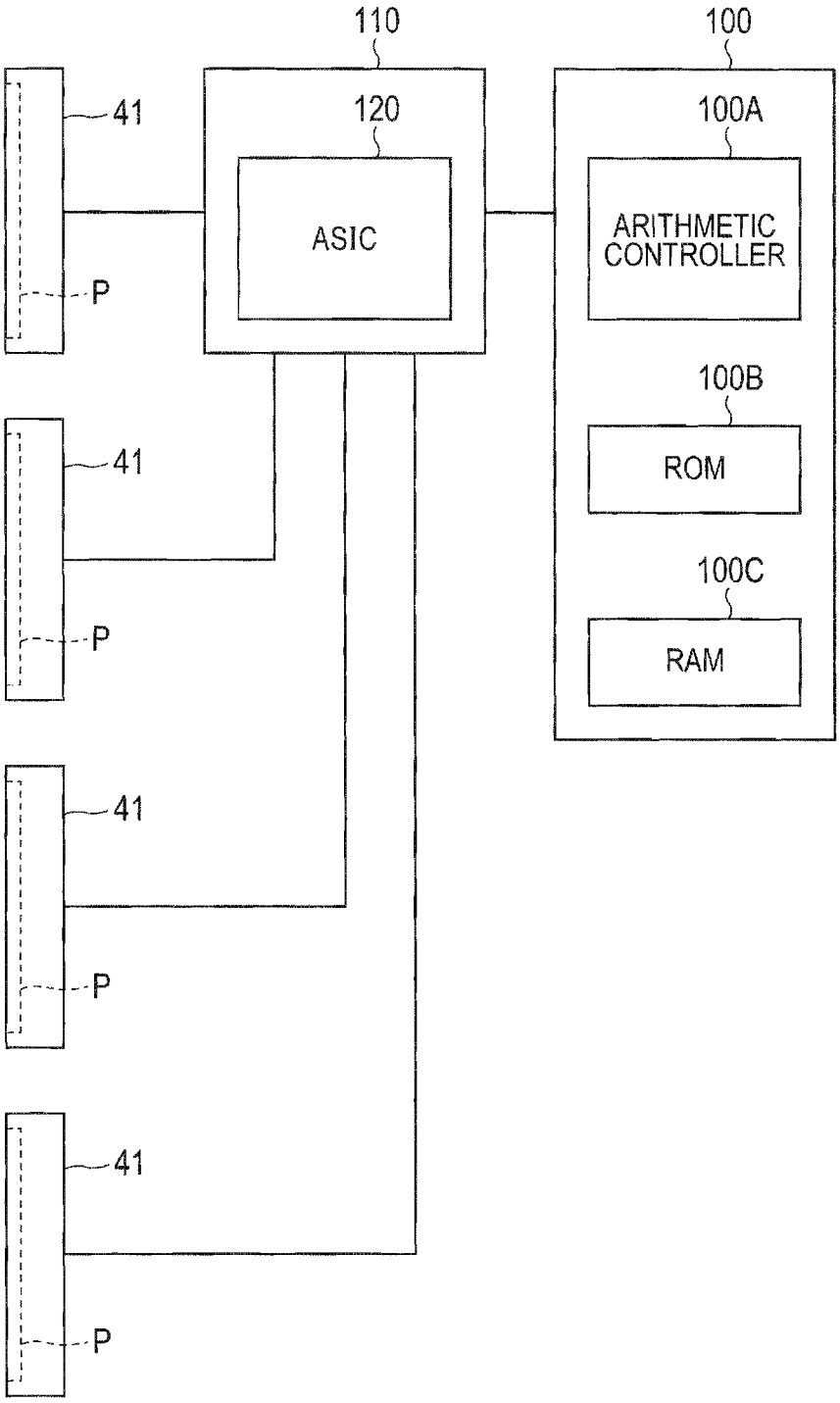
FIG. 5 is a block diagram of a light emission controller and a controller.

The controller 100 controls the entirety of the color printer 1. As shown in FIG. 5, the controller 100 includes an arithmetic controller 100A such as CPU, a ROM 100B, and a RAM 100C. The controller 100 executes computer programs that are preliminarily stored, thereby realizing each function. A light emission controller 110 controls light emission of each light emitting element P of the LED head 41, in cooperation with the controller 100. The light emission controller 110 includes an ASIC 120. Four sets of the LED heads 41 are commonly connected to the light emission controller 110, and the ASIC 120 of the light emission controller 110 is configured to collectively control light emission of the four sets of the LED heads 41.

Hereinafter, the configuration of the controller 100 will be described.

Figure 6A:
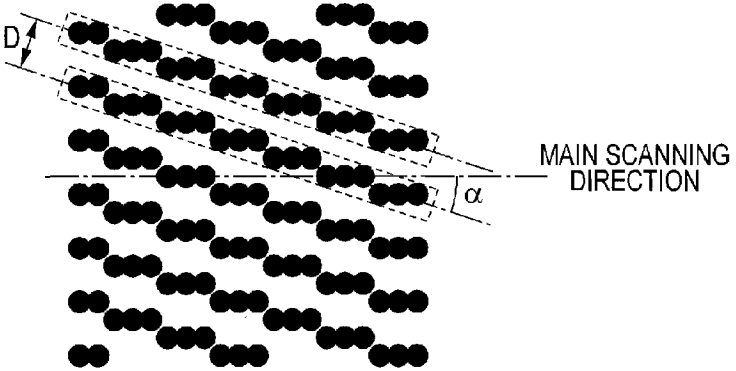
Figure 6B:
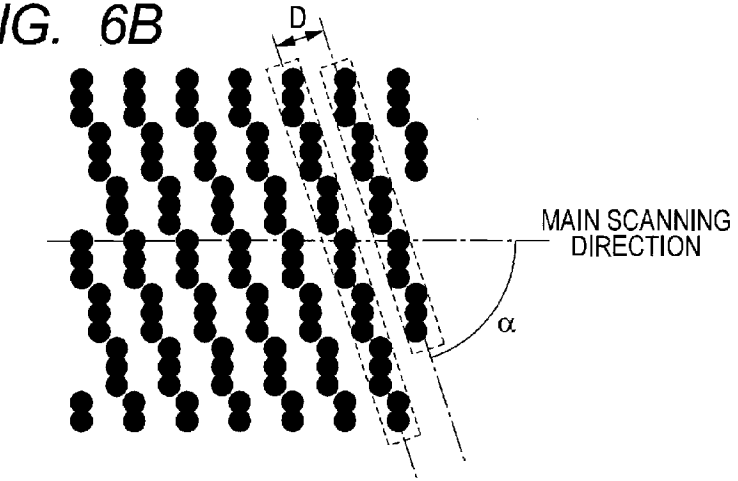
Figure 6C:
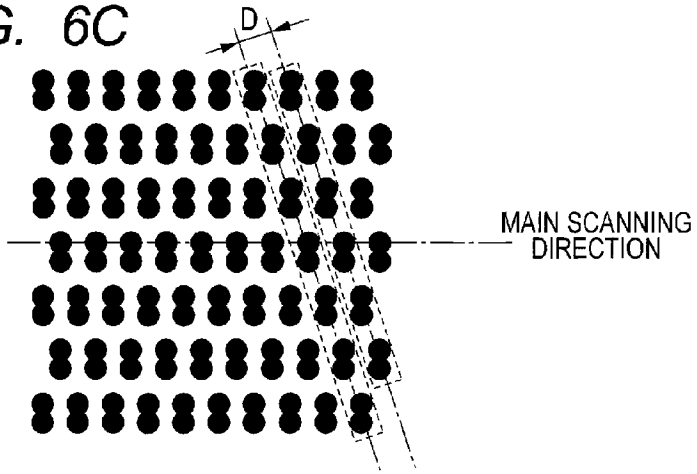

When forming a halftone image on sheet S, the controller 100 controls, through the light emission controller 110 (the ASIC 120), the LED heads 41 to form a halftone electrostatic latent image on the photosensitive surface 53A by hatching having oblique lines that are inclined relative to the main scanning direction. For example, as shown in FIG. 6A, when forming an image of density 33%, the controller 100 controls the LED heads 41 to form hatching by straight lines of a relatively small inclination angle $\alpha$ relative to the main scanning direction, thereby forming a halftone electrostatic image. As shown in FIG. 6B, the controller 100 may control the LED heads 41 to form an image of density 33% while increasing the inclination angle $\alpha$ of oblique lines relative to the main scanning direction, compared with the case of FIG. 6A. As shown in FIG. 6C, the controller 100 may control the LED heads 41 to form an image of density 33% by using a smaller interval of pixels to be exposed in the main scanning direction than the case of FIG. 6B and by reducing the number of pixels that are continuously exposed in the sub-scanning direction. In FIG. 6C, the inclination angle $\alpha$ of oblique lines relative to the main scanning direction is equal to the inclination angle $\alpha$ in FIG. 6B, and a line-to-line distance D of adjacent oblique lines in FIG. 6C is smaller than that of FIG. 6B.

Here, the oblique lines of this disclosure mean pseudo (imaginary) lines obtained by connecting pixels exposed by a plurality of light emitting elements (for example, the region surrounded by the dashed lines in FIGS. 6A to 6D). The line-to-line distance D between adjacent oblique lines means the distance between the center lines of the adjacent oblique lines.

The controller 100 changes hatching pattern depending on the color (cyan, magenta, black, and yellow) of the photosensitive surface 53A to be exposed.

Figure 6D:
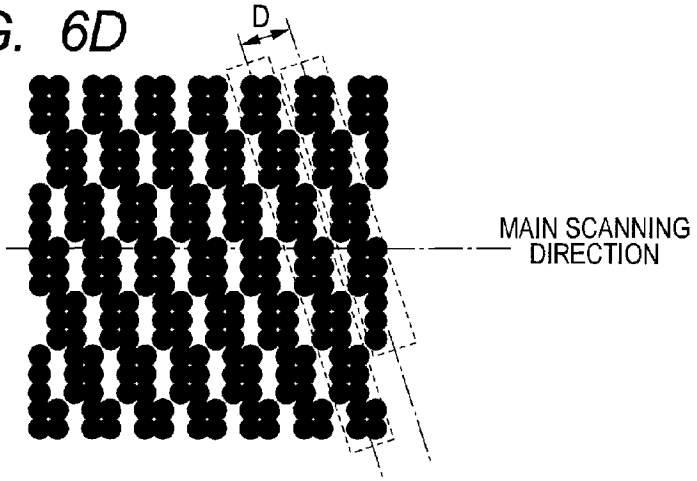

When changing the density of a halftone image, the controller 100 changes the ratio of pixels to be exposed. For example, as shown in FIG. 6D, when forming an image of density 66%, the controller 100 increases the number of light emitting elements P emitting light in the main scanning direction to twice the case of FIG. 6B, thereby thickening oblique lines that form hatching. The line-to-line distance D in FIG. 6D is the same as the case in FIG. 6B. Alternatively, an image of density 66% may be formed by reducing the line-to-line distance D.

Next, an example of correction of exposure amount at a joint of chips CH will be described.

Figure 7A:
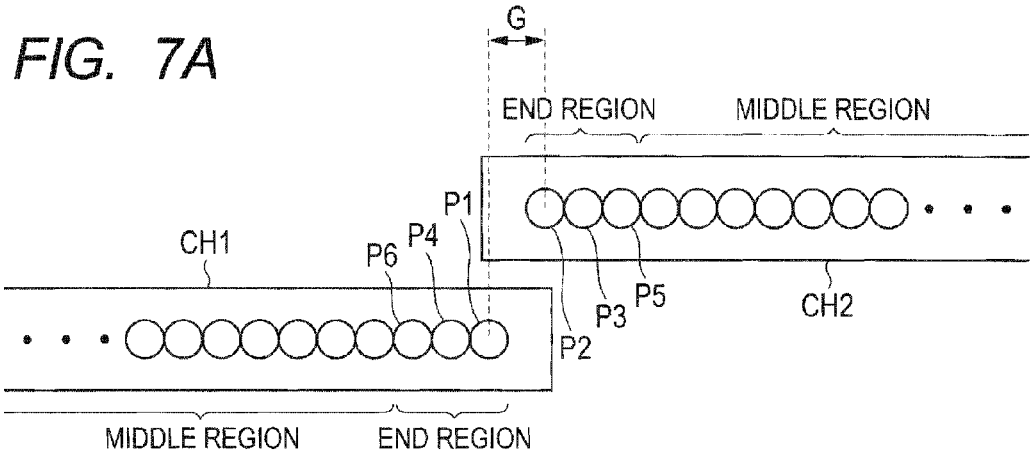
FIG. 7A is an enlarged view showing a joint of chips in a case where an interval of the joint of the chips is large.

As shown in FIG. 7A, each chip CH has an end region and a middle region. The end region is a region in which at least one light emitting element P close to an adjacent chip is arranged. The middle region is a region in which light emitting elements P other than the light emitting element P in the end region are arranged. In the present embodiment, the end region is defined as a region in which three light emitting elements P from the end of each chip CH (P1 to P6 in FIG. 7A) are arranged, and the middle region is defined as a region in which other light emitting elements P are arranged. As will be described later, the exposing device of this disclosure may correct the exposure amount of only one of three light emitting elements P in the end region, or may correct the exposure amounts of three light emitting elements P in the end region.

Figure 7B:
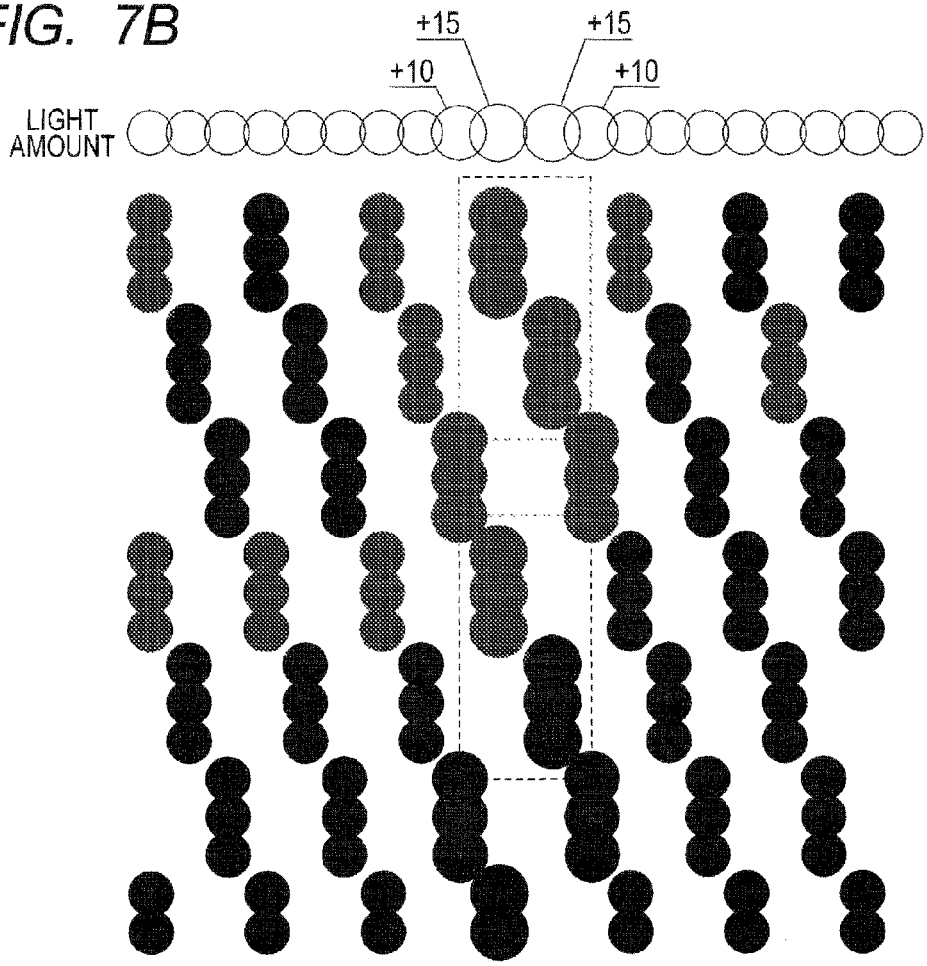
FIG. 7B is a diagram showing correction of exposure amounts in a case where the interval of the joint of the chips is large, according to a comparative example.

FIG. 7B shows light amounts after correction by the size of circles and numbers (correction amounts) and also shows a specific diagram of hatching arranged below the circles. In the comparative example shown in FIG. 7B, the correction amount (light amount) of the first light emitting element P1 on the first chip CH1 closest to the second chip CH2 is +15, the correction amount of the second light emitting element P2 on the second chip CH2 closest to the first chip CH1 is +15, the correction amount of a third light emitting element P3 on the second chip CH2 adjacent to the second light emitting element P2 is +10, and the correction amount of a fourth light emitting element P4 on the first chip CH1 adjacent to the first light emitting element P1 is +10. That is, when the interval G at the joint of chips CH is larger than the standard pitch, the correction amounts of the light emitting elements P closest to the joint are set to be large. And, as the light emitting elements P are away farther from the joint, the correction amounts are set to be smaller.

According to such light amount correction, as shown in FIG. 7B, when an exposure pixel by the first light emitting element P1 and an exposure pixel by the second light emitting element P2 are adjacent to each other, both of these exposure pixel are formed as larger pixels, and thus densities of these pixels strengthen each other to form a high density portion. For example, a set of large pixels surrounded by the dashed lines in FIG. 7B looks like a dotted region of high density. This dotted region is arrayed in the sub-scanning direction (the upper-lower direction in FIG. 7B) and, due to this, a color streak appears in a printed image.

Figure 8A:
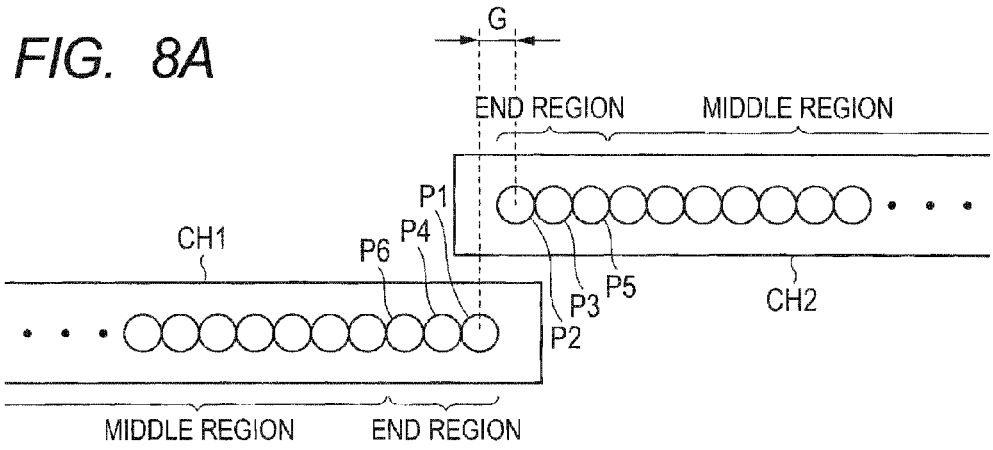
FIG. 8A is an enlarged view showing a joint of chips in a case where an interval of the joint of the chips is small.
Figure 8B:
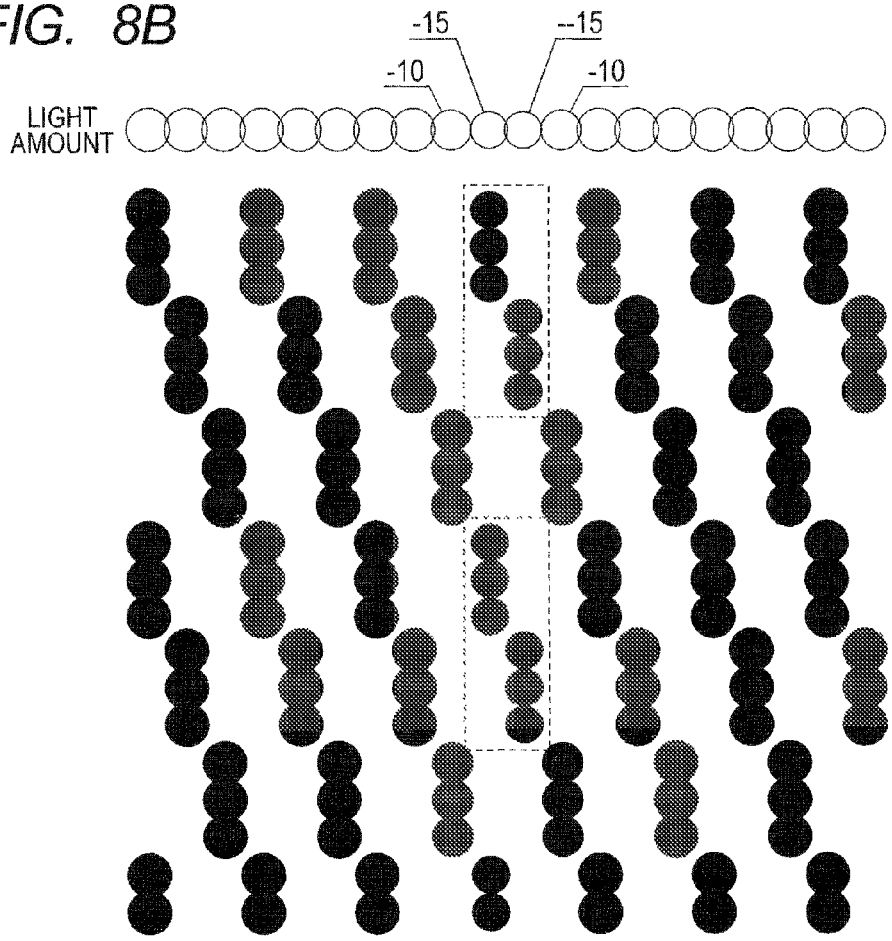
FIG. 8B is a diagram showing correction of exposure amounts in a case where the interval of the joint of the chips is small, according to a comparative example.

Further, in the comparative example, when the interval G between the chips CH is smaller than the standard pitch as shown in FIG. 8A, as shown in FIG. 8B, the correction amounts of the first light emitting element P1 and the second light emitting element P2 are set to −15 (that is, the light amount is corrected to be smaller than the light amount of the light emitting elements P in the middle region), and the correction amounts of the third light emitting element P3 and the fourth light emitting element P4 are set to −10. With this method, both of the pixels by the first light emitting element P1 and the second light emitting element P2 surrounded by the dashed lines are small, and hence the densities of these pixels weaken each other to form a low density portion. For example, a set of small pixels surrounded by the dashed lines in FIG. 8B looks like a dotted region of low density. This dotted region is arrayed in the sub-scanning direction and, due to this, a white streak appears in a printed image.

In this way, in the exposing device of the present embodiment, the exposure amount at the joint of the chips CH is corrected described below so that the exposure amount does not become too small or too large due to correction of the exposure amount.

The controller 100 controls, through the light emission controller 110 (the ASIC 120), the LED heads 41 to form a halftone electrostatic latent image on the photosensitive surface 53A by hatching including oblique lines inclined relative to the main scanning direction. At this time, first, when the interval G is larger than a first particular value Gth1, the controller 100 performs controls such that the light amount of the first light emitting element P1 and the light amount of the second light emitting element P2 are larger than the light amount of the light emitting elements P in the middle region and that the light amount of the second light emitting element P2 is smaller than the light amount of the first light emitting element P1. On the other hand, when the interval G is smaller than a second particular value Gth2, the controller 100 performs controls such that the light amount of the first light emitting element P1 and the light amount of the second light emitting element P2 are smaller than the light amount of the light emitting elements P in the middle region and that the light amount of the second light emitting element P2 is larger than the light amount of the first light emitting element P1.

For example, in the tables of correction patterns shown in FIGS. 9A and 9B, as shown in correction patterns 1 to 6 in FIG. 9A and correction patterns 1 to 6 in FIG. 9B, correction is performed such that the light amount of the first light emitting element P1 is different from the light amount of the second light emitting element P2. With this correction, when the interval G is large, the light amounts of the first light emitting element P1 and the second light emitting element P2 are set to be larger than the light amount of the light emitting elements P in the middle region, so as to suppress occurrence of a white streak. Further, in this light amount correction, the light amount of the second light emitting element P2 is set to be smaller than the light amount of the first light emitting element P1, thereby suppressing occurrence of a color streak due to excessive strengthening of the pixel by the first light emitting element P1 and the pixel by the second light emitting element P2.

Conversely, when the interval G is small, the light amounts of the first light emitting element P1 and the second light emitting element P2 are set to be smaller than the light amount of the light emitting elements P in the middle region, so as to suppress occurrence of a color streak. Further, in this light amount correction, the light amount of the second light emitting element P2 is set to be larger than the light amount of the first light emitting element P1, thereby suppressing occurrence of a white streak due to excessive weakening of the pixel by the first light emitting element P1 and the pixel by the second light emitting element P2.

As a more preferable embodiment, when the interval G is larger than the first particular value Gth1, the controller 100 performs control such that the light amount of the third light emitting element P3 is larger than or equal to the light amount of the second light emitting element P2. At this time, it is more preferable that the light amount of the third light emitting element P3 be smaller than or equal to the light amount of the first light emitting element P1. On the other hand, when the interval G is smaller than the second particular value Gth2, the controller 100 performs control such that the light amount of the third light emitting element P3 is smaller than or equal to the light amount of the second light emitting element P2. At this time, it is more preferable that the light amount of the third light emitting element P3 be larger than or equal to the light amount of the first light emitting element P1.

For example, in the tables of correction patterns shown in FIGS. 9A and 9B, as shown in correction patterns 2 to 6 in FIG. 9A and correction patterns 2 to 6 in FIG. 9B, the light amount of the third light emitting element P3 is corrected. With this correction, when the interval G is large, shortage of the exposure amount around the joint can be suppressed. When the interval G is small, excessive exposure amount around the joint can be suppressed.

As a more preferable embodiment, when the interval G is larger than the first particular value Gth1, the controller 100 performs control such that the light amount of the fourth light emitting element P4 is larger than the light amount of the light emitting elements P in the middle region. At this time, it is more preferable that the light amount of the fourth light emitting element P4 be smaller than or equal to the light amount of the first light emitting element P1. On the other hand, when the interval G is smaller than the second particular value Gth2, the controller 100 performs control such that the light amount of the fourth light emitting element P4 is smaller than the light amount of the light emitting elements P in the middle region. At this time, it is more preferable that the light amount of the fourth light emitting element P4 be larger than or equal to the light amount of the first light emitting element P1.

For example, in the tables of correction patterns shown in FIGS. 9A and 9B, as shown in correction patterns 4 to 6 in FIG. 9A and correction patterns 4 to 6 in FIG. 9B, the light amount of the fourth light emitting element P4 is corrected. With this correction, when the interval G is large, shortage of the exposure amount around the joint can be further suppressed. When the interval G is small, excessive exposure amount around the joint can be further suppressed.

When correction of the light amount is performed for four light emitting elements of the first light emitting element P1 to the fourth light emitting element P4, the controller 100 may perform control such that the sum of the light amount of the first light emitting element P1 and the light amount of the fourth light emitting element P4 is equal to the sum of the light amount of the second light emitting element P2 and the light amount of the third light emitting element P3.

For example, in the tables of correction patterns shown in FIGS. 9A and 9B, the light amounts are corrected as shown in correction patterns 5 and 6 in FIG. 9A and correction patterns 5 and 6 in FIG. 9B. With this correction, the light amount of the end region of the first chip CH1 is equal to the light amount of the end region of the second chip CH2, and density unevenness around the joint of the chips CH can be further suppressed. For example, when the light amount is controlled based on a lighting period, whether the sums of the light amount are the same can be determined based on whether the sums of lighting periods are the same. When the light amount is controlled based on the magnitude of electric current, whether the sums of the light amount are the same can be determined based on whether the sums of electric current values are the same.

In the above-described light amount correction, the first particular value Gth1 and the second particular value Gth2 may be the same value, for example, the standard pitch, or may be different values from each other.

The controller 100 may determine whether an inclination angle $\alpha$ is larger than a particular angle. The inclination angle $\alpha$ is an acute angle (<90 deg.) formed between one of the oblique lines and the main scanning direction as shown in FIGS. 6A to 6D. When the inclination angle $\alpha$ (in other words, the angle of the oblique lines forming hatching relative to the main scanning direction) is larger than the particular angle, the controller 100 may perform the above-described light amount correction. And, when the inclination angle $\alpha$ is smaller than or equal to the particular angle, the controller 100 may perform correction such that the light amount of the first light emitting element P1 is the same as the light amount of the second light emitting element P2 and that the light amount of the first light emitting element P1 and the light amount of the second light emitting element P2 are larger (FIG. 7B) or smaller (FIG. 8B) than the light amount of the light emitting elements in the middle region. That is, when the inclination angle $\alpha$ a is small, the controller 100 may perform correction in a conventional manner.

Further, the controller 100 may determine whether the line-to-line distance D of adjacent oblique lines is smaller than a particular distance or whether the halftone density is higher than a particular density. When the line-to-line distance D of adjacent oblique lines is smaller than the particular distance or when the halftone density is higher than the particular density, the controller 100 may perform the above-described light amount correction. And, when the line-to-line distance D is larger than or equal to the particular distance or when the halftone density is smaller than or equal to the particular density, the controller 100 may perform correction such that the light amount of the first light emitting element P1 is the same as the light amount of the second light emitting element P2 and that the light amount of the first light emitting element P1 and the light amount of the second light emitting element P2 are larger (FIG. 7B) or smaller (FIG. 8B) than the light amount of the light emitting elements P in the middle region. That is, when the line-to-line distance D is large or when the halftone density is low, the controller 100 may perform correction in a conventional manner.

The excessive strengthening and so on by the conventional light amount correction is likely to occur when the inclination angle $\alpha$ is large, when the line-to-line distance D is small, and when the halftone density is high. Thus, the above-described light amount correction is performed when the inclination angle $\alpha$ is larger than or equal to the particular angle, when the line-to-line distance D is smaller than or equal to the particular distance, and when the halftone density is higher than or equal to the particular density, and the conventional correction is performed in the other cases. Compared with a case in which only the conventional light amount correction is performed, the above-described configuration suppresses occurrence of a color streak and a white streak due to excessive strengthening and weakening between pixels formed by the first light emitting element P1 and pixels formed by the second light emitting element P2.

Figure 10:
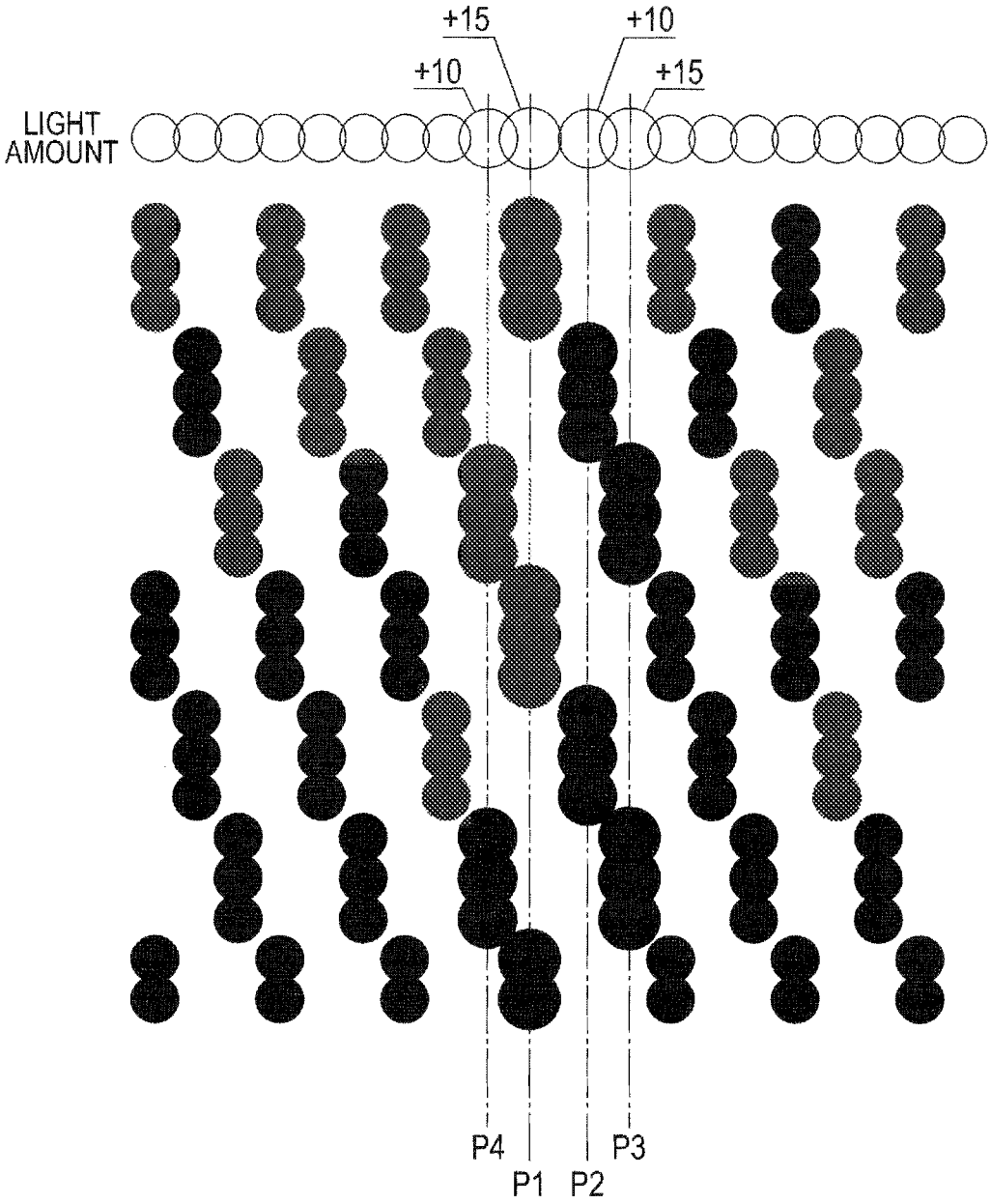
FIG. 10 is a diagram showing an example of correction of exposure amounts in a case where the interval of the joint of the chips is large.

As one example, if light amount correction is performed as shown in the correction pattern 5 in FIG. 9A, an image shown in FIG. 10 is formed. The example of FIG. 10 shows a case in which the interval G of the joint of the chips CH is larger than the first particular value Gth1. In this example, in the vicinity of the joint (between P1 and P2), the first light emitting element P1 and the second light emitting element P2 are corrected to light amounts larger than the light amount in the middle region. But, because the light amount of the second light emitting element P2 is smaller than the light amount of the first light emitting element P1, the pixels formed by the first light emitting element P1 and the pixels formed by the second light emitting element P2 do not strengthen each other excessively, thereby suppressing occurrence of a color streak. Further, the sum of the light amount of the first light emitting element P1 and the light amount of the fourth light emitting element P4 is equal to the sum of the light amount of the second light emitting element P2 and the light amount of the third light emitting element P3. Thus, density unevenness around the joint can be suppressed effectively.

While the disclosure has been described in detail with reference to the above aspects thereof, it would be apparent to those skilled in the art that various changes and modifications may be made therein without departing from the scope of the claims.

In the embodiment, the light amount is corrected for two light emitting elements in each end region (four light emitting elements of the first light emitting element P1 to the fourth light emitting element P4). However, the light amount may be corrected for the three (or more) light emitting elements P from each end. For example, as shown in the correction pattern 6 of FIGS. 9A and 9B, the light amount may be corrected for a fifth light emitting element P5 adjacent to the third light emitting element P3 on the second chip CH2 at the opposite side from the second light emitting element P2, and for a sixth light emitting element P6 adjacent to the fourth light emitting element P4 on the first chip CH1 at the opposite side from the first light emitting element P1. At this time, when the interval G is larger than the first particular value Gth1, it is preferable that the light amounts of the fifth light emitting element P5 and the sixth light emitting element P6 be larger than the light amount of the light emitting element in the middle region and be smaller than the light amount of the first light emitting element P1 to the fourth light emitting element P4.

Further, in the correction patterns in FIGS. 9A and 9B, some of correction amounts of the second light emitting element P2, the third light emitting element P3, and the fourth light emitting element P4 are +10 or −10. A part or all of these correction amounts of the light emitting elements may be changed to +5 or −5, respectively, which is smaller by one step.

In the embodiment, the LED elements are shown as an example of the light emitting elements P. However, light emitting elements other than LED may be used.

In the embodiment, the photosensitive surface 53A of the photosensitive drum 53 is shown as an example of the photosensitive surface. However, the photosensitive member may be a belt shape.

In the embodiment, the controller 100 and the light emission controller 110 control light emission of each light emitting element P of the LED head 41, in cooperation with each other. However, only one of the controller and the light emission controller may be provided to perform such light emission control.

In the embodiment, the color printer 1 is described as an example of the image forming apparatus. However, this disclosure may be applied to an exposing device used in a monochromatic image forming apparatus, or may be applied to a copier, a multifunction peripheral (MFP), and so on, instead of a printer.

What is claimed is:

1. An exposing device comprising:

a light emitting head having a plurality of chips arranged in a main scanning direction, the plurality of chips including a first chip and a second chip closest to the first chip, each of the plurality of chips having a plurality of light emitting elements arranged in the main scanning direction, the plurality of light emitting elements emitting light to a photosensitive surface, each of the plurality of chips having an end region and a middle region, the end region being a region having at least one of the plurality of light emitting elements close to an adjacent chip, the middle region being a region having the plurality of light emitting elements other than the at least one of the plurality of light emitting elements in the end region; and a controller connected to the light emitting head, wherein:

the controller is configured to operate the light emitting head to form a halftone electrostatic latent image on the photosensitive surface by emitting light from the plurality of light emitting elements, the halftone electrostatic latent image being an image made by hatching having oblique lines inclined relative to the main scanning direction; and when an interval between the first chip and the second chip in the main scanning direction is larger than a first particular value, the controller is configured to control the plurality of light emitting elements to emit light such that a light amount of a first light emitting element and a light amount of a second light emitting element are larger than light amounts of light emitting elements in the middle region and that the light amount of the second light emitting element is smaller than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

2. The exposing device according to claim 1, wherein the controller is configured to control the plurality of light emitting elements to emit light such that a light amount of a third light emitting element is larger than or equal to the light amount of the second light emitting element, the third light emitting element being a light emitting element provided on the second chip and adjacent to the second light emitting element, the third light emitting element being in the end region of the second chip.

3. The exposing device according to claim 2, wherein the controller is configured to control the plurality of light emitting elements to emit light such that the light amount of the third light emitting element is smaller than or equal to the light amount of the first light emitting element.

4. The exposing device according to claim 2, wherein the controller is configured to control the plurality of light emitting elements to emit light such that a light amount of a fourth light emitting element is larger than the light amounts of the light emitting elements in the middle region, the fourth light emitting element being a light emitting element provided on the first chip and adjacent to the first light emitting element, the fourth light emitting element being in the end region of the first chip.

5. The exposing device according to claim 4, wherein the controller is configured to control the plurality of light emitting elements to emit light such that the light amount of the fourth light emitting element is smaller than or equal to the light amount of the first light emitting element.

6. The exposing device according to claim 4, wherein the controller is configured to control the plurality of light emitting elements to emit light such that a sum of the light amount of the first light emitting element and the light amount of the fourth light emitting element is same as a sum of the light amount of the second light emitting element and the light amount of the third light emitting element.

7. The exposing device according to claim 1, wherein the controller is configured to:

determine whether an inclination angle is larger than a particular angle, the inclination angle being an acute angle formed between one of the oblique lines and the main scanning direction;

in response to determining that the inclination angle is larger than the particular angle when the interval is larger than the first particular value, control the plurality of light emitting elements to emit light such that the light amount of the first light emitting element and the light amount of the second light emitting element are larger than light amounts of light emitting elements in the middle region and that the light amount of the second light emitting element is smaller than the light amount of the first light emitting element; and in response to determining that the inclination angle is smaller than or equal to the particular angle when the interval is larger than the first particular value, control the plurality of light emitting elements to emit light such that the light amount of the first light emitting element and the light amount of the second light emitting element are larger than light amounts of light emitting elements in the middle region and that the light amount of the second light emitting element is same as the light amount of the first light emitting element.

8. The exposing device according to claim 1, wherein the controller is configured to:

determine whether a line-to-line distance is smaller than a particular distance, the line-to-line distance being a distance between center lines of adjacent ones of the oblique lines;

in response to determining that the line-to-line distance is smaller than the particular distance when the interval is larger than the first particular value, control the plurality of light emitting elements to emit light such that the light amount of the first light emitting element and the light amount of the second light emitting element are larger than light amounts of light emitting elements in the middle region and that the light amount of the second light emitting element is smaller than the light amount of the first light emitting element; and in response to determining that the line-to-line distance is longer than or equal to the particular distance when the interval is larger than the first particular value, control the plurality of light emitting elements to emit light such that the light amount of the first light emitting element and the light amount of the second light emitting element are larger than light amounts of light emitting elements in the middle region and that the light amount of the second light emitting element is same as the light amount of the first light emitting element.

9. The exposing device according to claim 1, wherein the controller is configured to:

determine whether a halftone density is higher than a particular density, the halftone density being density of the hatching formed by the oblique lines;

in response to determining that the halftone density is higher than the particular density when the interval is larger than the first particular value, control the plurality of light emitting elements to emit light such that the light amount of the first light emitting element and the light amount of the second light emitting element are larger than light amounts of light emitting elements in the middle region and that the light amount of the second light emitting element is smaller than the light amount of the first light emitting element; and in response to determining that the halftone density is lower than or equal to the particular density when the interval is larger than the first particular value, control the plurality of light emitting elements to emit light such that the light amount of the first light emitting element and the light amount of the second light emitting element are larger than light amounts of light emitting elements in the middle region and that the light amount of the second light emitting element is same as the light amount of the first light emitting element.

10. An exposing device comprising:

a light emitting head having a plurality of chips arranged in a main scanning direction, the plurality of chips including a first chip and a second chip closest to the first chip, each of the plurality of chips having a plurality of light emitting elements arranged in the main scanning direction, the plurality of light emitting elements emitting light to a photosensitive surface, each of the plurality of chips having an end region and a middle region, the end region being a region having at least one of the plurality of light emitting elements close to an adjacent chip, the middle region being a region having the plurality of light emitting elements other than the at least one of the plurality of light emitting elements in the end region; and a controller connected to the light emitting head, wherein:

the controller is configured to operate the light emitting head to form a halftone electrostatic latent image on the photosensitive surface by emitting light from the plurality of light emitting elements, the halftone electrostatic latent image being an image made by hatching having oblique lines inclined relative to the main scanning direction; and when an interval between the first chip and the second chip in the main scanning direction is smaller than a second particular value, the controller is configured to control the plurality of light emitting elements to emit light such that a light amount of a first light emitting element and a light amount of a second light emitting element are smaller than light amounts of light emitting elements in the middle region and that the light amount of the second light emitting element is larger than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

11. The exposing device according to claim 10, wherein the controller is configured to control the plurality of light emitting elements to emit light such that a light amount of a third light emitting element is smaller than or equal to the light amount of the second light emitting element, the third light emitting element being a light emitting element provided on the second chip and adjacent to the second light emitting element, the third light emitting element being in the end region of the second chip.

12. The exposing device according to claim 11, wherein the controller is configured to control the plurality of light emitting elements to emit light such that the light amount of the third light emitting element is larger than or equal to the light amount of the first light emitting element.

13. The exposing device according to claim 12, wherein the controller is configured to control the plurality of light emitting elements to emit light such that a light amount of a fourth light emitting element is smaller than the light amounts of the light emitting elements in the middle region, the fourth light emitting element being a light emitting element provided on the first chip and adjacent to the first light emitting element, the fourth light emitting element being in the end region of the first chip.

14. The exposing device according to claim 13, wherein the controller is configured to control the plurality of light emitting elements to emit light such that the light amount of the fourth light emitting element is larger than or equal to the light amount of the first light emitting element.

15. The exposing device according to claim 13, wherein the controller is configured to control the plurality of light emitting elements to emit light such that a sum of the light amount of the first light emitting element and the light amount of the fourth light emitting element is same as a sum of the light amount of the second light emitting element and the light amount of the third light emitting element.

16. The exposing device according to claim 10, wherein the controller is configured to:

determine whether an inclination angle is larger than a particular angle, the inclination angle being an acute angle formed between one of the oblique lines and the main scanning direction;

in response to determining that the inclination angle is larger than the particular angle when the interval is smaller than the second particular value, control the plurality of light emitting elements to emit light such that the light amount of the first light emitting element and the light amount of the second light emitting element are smaller than light amounts of light emitting elements in the middle region and that the light amount of the second light emitting element is larger than the light amount of the first light emitting element; and in response to determining that the inclination angle is smaller than or equal to the particular angle when the interval is smaller than the second particular value, control the plurality of light emitting elements to emit light such that the light amount of the first light emitting element and the light amount of the second light emitting element are smaller than light amounts of light emitting elements in the middle region and that the light amount of the second light emitting element is same as the light amount of the first light emitting element.

17. The exposing device according to claim 10, wherein the controller is configured to:

determine whether a line-to-line distance is smaller than a particular distance, the line-to-line distance being a distance between center lines of adjacent ones of the oblique lines;

in response to determining that the line-to-line distance is smaller than the particular distance when the interval is smaller than the second particular value, control the plurality of light emitting elements to emit light such that the light amount of the first light emitting element and the light amount of the second light emitting element are smaller than light amounts of light emitting elements in the middle region and that the light amount of the second light emitting element is larger than the light amount of the first light emitting element; and in response to determining that the line-to-line distance is longer than or equal to the particular distance when the interval is smaller than the second particular value, control the plurality of light emitting elements to emit light such that the light amount of the first light emitting element and the light amount of the second light emitting element are smaller than light amounts of light emitting elements in the middle region and that the light amount of the second light emitting element is same as the light amount of the first light emitting element.

18. The exposing device according to claim 10, wherein the controller is configured to:

determine whether a halftone density is higher than a particular density, the halftone density being density of the hatching formed by the oblique lines;

in response to determining that the halftone density is higher than the particular density when the interval is smaller than the second particular value, control the plurality of light emitting elements to emit light such that the light amount of the first light emitting element and the light amount of the second light emitting element are smaller than light amounts of light emitting elements in the middle region and that the light amount of the second light emitting element is larger than the light amount of the first light emitting element; and in response to determining that the halftone density is lower than or equal to the particular density when the interval is smaller than the second particular value, control the plurality of light emitting elements to emit light such that the light amount of the first light emitting element and the light amount of the second light emitting element are smaller than light amounts of light emitting elements in the middle region and that the light amount of the second light emitting element is same as the light amount of the first light emitting element.

19. A method of controlling an exposing device including a light emitting head having a plurality of chips arranged in a main scanning direction, the plurality of chips including a first chip and a second chip closest to the first chip, each of the plurality of chips having a plurality of light emitting elements arranged in the main scanning direction, the plurality of light emitting elements emitting light to a photosensitive surface, each of the plurality of chips having an end region and a middle region, the end region being a region having at least one of the plurality of light emitting elements close to an adjacent chip, the middle region being a region having the plurality of light emitting elements other than the at least one of the plurality of light emitting elements in the end region, the method comprising:

operating the light emitting head to form a halftone electrostatic latent image on the photosensitive surface by emitting light from the plurality of light emitting elements, the halftone electrostatic latent image being an image made by hatching having oblique lines inclined relative to the main scanning direction, the operating the light emitting head comprising:

when an interval between the first chip and the second chip in the main scanning direction is larger than a first particular value, controlling the plurality of light emitting elements to emit light such that a light amount of a first light emitting element and a light amount of a second light emitting element are larger than light amounts of light emitting elements in the middle region and that the light amount of the second light emitting element is smaller than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

20. A non-transitory computer-readable storage medium storing instructions executable by a controller of an exposing device, the exposing device including a light emitting head having a plurality of chips arranged in a main scanning direction, the plurality of chips including a first chip and a second chip closest to the first chip, each of the plurality of chips having a plurality of light emitting elements arranged in the main scanning direction, the plurality of light emitting elements emitting light to a photosensitive surface, each of the plurality of chips having an end region and a middle region, the end region being a region having at least one of the plurality of light emitting elements close to an adjacent chip, the middle region being a region having the plurality of light emitting elements other than the at least one of the plurality of light emitting elements in the end region, the instructions, when executed by the controller, causing the exposing device to perform:

operating the light emitting head to form a halftone electrostatic latent image on the photosensitive surface by emitting light from the plurality of light emitting elements, the halftone electrostatic latent image being an image made by hatching having oblique lines inclined relative to the main scanning direction, the operating the light emitting head comprising:

when an interval between the first chip and the second chip in the main scanning direction is larger than a first particular value, controlling the plurality of light emitting elements to emit light such that a light amount of a first light emitting element and a light amount of a second light emitting element are larger than light amounts of light emitting elements in the middle region and that the light amount of the second light emitting element is smaller than the light amount of the first light emitting element, the first light emitting element being a light emitting element provided on the first chip and closest to the second chip, the second light emitting element being a light emitting element provided on the second chip and closest to the first chip, the first light emitting element being in the end region of the first chip, the second light emitting element being in the end region of the second chip.

* * * * *